US009366387B2

(12) United States Patent
Aburto Anell et al.

(10) Patent No.: US 9,366,387 B2
(45) Date of Patent: Jun. 14, 2016

(54) PROCESS OF PREPARING IMPROVED HEAVY AND EXTRA HEAVY CRUDE OIL EMULSIONS BY USE OF BIOSURFACTANTS IN WATER AND PRODUCT THEREOF

(75) Inventors: Jorge Arturo Aburto Anell, Mexico City (MX); Beatriz Zapata Rendón, Mexico City (MX); María de Lourdes Araceli Mosqueira Mondragón, Mexico City (MX); Luis Manuel Quej Aké, Mexico City (MX); Eugenio Alejandro Flores Oropeza, Mexico City (MX); Flavio Salvador Vázquez Moreno, Mexico City (MX); Cesar Bernal Huicochea, Mexico City (MX); Juan de la Cruz Clavel López, Mexico City (MX); Mario Ramírez de Santiago, Mexico City (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 679 days.

(21) Appl. No.: 12/967,564

(22) Filed: Dec. 14, 2010

(65) Prior Publication Data

US 2011/0139262 A1 Jun. 16, 2011

(30) Foreign Application Priority Data

Dec. 15, 2009 (MX) ..... MX/a/2009/013705

(51) Int. Cl.
*C10L 1/32* (2006.01)
*F17D 1/17* (2006.01)

(52) U.S. Cl.
CPC . *F17D 1/17* (2013.01); *C10L 1/328* (2013.01); *Y10S 516/924* (2013.01); *Y10S 516/928* (2013.01); *Y10T 137/0391* (2015.04)

(58) Field of Classification Search
CPC ..... C08L 5/14; F17D 1/17; C10L 1/328; Y10T 137/0391; B01F 17/0021; B01F 17/0057; B01F 2003/0826; B01F 2003/105; Y10S 516/924; Y10S 516/928
USPC ..... 516/67, 69, 73, 72, 43, 46; 137/13; 44/301; 585/899
See application file for complete search history.

(56) References Cited

U.S. PATENT DOCUMENTS

| | | | | |
|---|---|---|---|---|
| 3,305,379 | A * | 2/1967 | Ferm | 106/277 |
| 3,943,954 | A | 3/1976 | Flournoy et al. | |
| 4,801,304 | A * | 1/1989 | Polanco et al. | 44/301 |
| 4,934,398 | A * | 6/1990 | Chirinos et al. | 137/13 |
| 4,943,390 | A * | 7/1990 | Hayes et al. | 516/59 |
| 4,978,365 | A | 12/1990 | Gregoli et al. | |
| 5,000,872 | A | 3/1991 | Olah | |
| 5,013,462 | A * | 5/1991 | Danley | 507/243 |
| 5,083,613 | A | 1/1992 | Gregoli et al. | |
| 5,156,652 | A | 10/1992 | Gregoli et al. | |
| 5,283,001 | A * | 2/1994 | Gregoli et al. | 516/67 |
| 5,320,671 | A | 6/1994 | Schilling | |
| 5,411,558 | A * | 5/1995 | Taniguchi et al. | 44/301 |
| 5,539,044 | A | 7/1996 | Dindi et al. | |
| 5,551,956 | A * | 9/1996 | Moriyama et al. | 44/301 |
| 5,792,223 | A | 8/1998 | Rivas et al. | |
| 5,863,301 | A * | 1/1999 | Grosso et al. | 44/301 |
| 5,879,419 | A * | 3/1999 | Moriyama et al. | 44/301 |
| 6,077,322 | A | 6/2000 | Shiao | |
| 6,090,754 | A * | 7/2000 | Chan et al. | 507/110 |
| 6,677,387 | B2 * | 1/2004 | Gurfinkel Castillo et al. | 516/53 |
| 7,338,924 | B2 | 3/2008 | Varadaraj | |
| 8,193,125 | B2 * | 6/2012 | Muller et al. | 507/138 |
| 2005/0090565 | A1 * | 4/2005 | Sprague | 516/73 |
| 2008/0153929 | A1 | 6/2008 | Miyahara et al. | |
| 2009/0008091 | A1 * | 1/2009 | Quintero et al. | 166/270.1 |
| 2009/0090658 | A1 * | 4/2009 | Burkus et al. | 208/390 |
| 2009/0221456 | A1 * | 9/2009 | Harrison et al. | 507/266 |

OTHER PUBLICATIONS

Schlumberger Oilfield Glossary, © 2013 Schlumberger Limited, online @ http://www.glossary.oilfield.slb.com/ , terms: "Heavy oil", "crude oil", "biopolymer", "API gravity", "asphaltic crude", "ultra heavy oil"; (downloaded Mar. 21, 2013), pp. 1-2.*

Guy Lebourgeois, "Producing Viscous Fluids", SPE, 806-G, May 1957. pp. 27-29.*

* cited by examiner

*Primary Examiner* — Daniel S Metzmaier
(74) *Attorney, Agent, or Firm* — Dickinson Wright PLLC

(57) ABSTRACT

A process allows working with viscous petroleum referred to as "heavy and extra heavy crudes" such as 20 to 6° API by adding an appropriate biosurfactant to an aqueous phase containing a biosurfactant active compound. The surfactant can be alkyl glycosides, glycerol esters and alkyl betaines. The result is the formation of a stable crude/water emulsion even with salt present therein.

23 Claims, 4 Drawing Sheets

PROCESS OF PREPARING IMPROVED HEAVY AND EXTRA HEAVY CRUDE OIL EMULSIONS BY USE OF BIOSURFACTANTS IN WATER AND PRODUCT THEREOF

CROSS-REFERENCE TO RELATED APPLICATION

This application claims the benefit under 35 U.S.C. §119 of Mexican Patent Application No. MX/a/2009/013705, filed Dec. 15, 2009, which is hereby incorporated by reference in its entirety.

DESCRIPTION

1. Field of the Invention

The present invention relates to a process for preparing heavy and extra heavy crude oil emulsions in water by adding an emulsifying agent to disperse the crude oil in water and facilitate both its production and transportation. The invention also relates to the type of the resulting emulsion according to the crude oil used and the preparation procedure.

2. Background of the Invention

Fuel viscosity is correlated to the average molecular weight of the material and viscosity increases with an increase of asphaltene content. Due to its high molecular weight and polar characteristics, asphaltenes often cause clogging problems both during crude oil extraction and transportation. Petroleum production in Mexico tends to increase in heavy crude oil extraction compared to light crude oil. It is essential to have technological alternatives, which allow for both production and transportation of heavy crude oil at low investment and production costs.

One method to reduce viscosity is the addition of an emulsifying agent in order to disperse crude oil in water and help in its production and transport. An understanding of how emulsions are produced from the crude oil, is necessary to control and improve every process stages. One challenge is to guarantee stability in crude oil-in-water emulsion along the piping by adding a surfactant. According to Gregoli A. et al, in order to obtain an homogeneous emulsion, first, it is important to obtain, based on a dynamic mixer, a premix comprising the emulsifying agent with water, brine or the like, so as to obtain a continuous interface between crude oil and the pre-emulsified agent in an aqueous solution The formation of stable emulsions implies droplets dispersion of one liquid into another immiscible liquid. In the case of heavy crude oil, a highly complex heterogeneous system due to the amount and structure of the compounds present therein and by being a hydrophobic matter, can disperse in sea water, the continuous aqueous media (continuous phase) of this kind of emulsion is regarded as Crude/$H_2O$. In the case of droplets $H_2O$ (dispersed phase) occurring in the bosom of the crude (continuous phase), the formed emulsion will be regarded as $H_2O$/Crude.

In the interface, an emulsifier or surfactant agent appears, as an essential component, which allows for the formation of the emulsion, decreasing surface tension as well as viscosity. Surfactant agents are comprised of a non-polar or lipophilic portion and a polar or hydrophilic portion. This property enables them to be arranged within the interface forming a monomolecular layer. In selecting the surfactant agent, basically, three properties are evaluated:

1) Solubility in $H_2O$, which increases with temperature.
2) Capability of decreasing surface tension.
3) Capability in forming micelles.

Micelles present in the continuous medium can increase solubility. The stability in the formed emulsion is increased by an increase in the number of droplets formed, as well as by a decrease in its size, it can be determined from the droplets size distribution, as dispersed in said continuous medium.

Generally, the emulsifier is added in a lower amount in relation to the crude oil (100-4000 ppm). This system should be highly stable. The limiting aspect is the requirement for a second operation in order to break the emulsion, which typically is comprised of 70% crude and 30% water. It is known that emulsion stability depends on a number of parameters, some of them being: petroleum composition in terms of active surface molecules, water salinity and pH, volumetric ratio of water, droplet size and dispersibility, temperature, surfactant type and concentration, mixing energy, among others. According to Hayes et al (1988), where distances for transporting crude are significantly large, which in turn lead to long time transit and/or non-scheduled stoppages in duct systems, or where extended storage times are required, the use of crude-in-water bioemulsions is advantageous. A significant number of studies exist, mostly in an experimental stage, carried out on petroleum-in-water emulsions. However, results from these studies are not always consistent. The reason for this is that emulsions behavior is complex, and as mentioned above, it depends on several factors.

An alternative to typical emulsions are biomolecules, that is, organic type and living being constituent molecules having surfactant properties, such as membrane lipids, oligonucleotides (DNA fractions), peptides (amino acid polymers), pigments and liposoluble vitamins; some of these compounds are already available in the market, mainly those used in the food and pharmaceutics industry, and prices thereof range from $0.1-5 USD/kilogram. However, there are few references regarding to these as being used in viscosity reduction of heavy crude oils in order to facilitate its transportation.

U.S. Pat. No. 6,077,322 (2000) discusses and discloses methods and additives for delaying water dispersion of bitumen-in-water emulsions, Orimulsion® is particularly discussed to which a cationic surfactant is added in order to stabilize the emulsion. Additives can be salts ($CaCl_2$ and $FeCl_3$) and flocculants (BETZ, a registered trademark form Betz Laboratories). Surfactants based on kerosene and TRITON RW-20 slightly increased the viscosity and did not cause any phase separation of the emulsion.

U.S. Pat. No. 5,792,223, 1998 describes the use of natural surfactants being present in bitumen to which an amine and an ethoxylated alcohol is added in order to activate it, and thus, stabilize the hydrocarbon in water emulsion.

Several other U.S. patents such as: U.S. Pat. No. 5,083,613 (1989), U.S. Pat. No. 5,000,872 (1988), U.S. Pat. No. 4,978,365 (1987), U.S. Pat. No. 5,156,652, US 20080153929, U.S. Pat. No. 7,338,924, U.S. Pat. No. 5,000,872, U.S. Pat. No. 5,320,671, U.S. Pat. No. 5,539,044 and U.S. Pat. No. 3,943,954 refer to new emulsifying agents for use in producing stable continuous-phase-hydrocarbon-in-water emulsions. Formation of emulsions, which are stable in the long term and, specifically, on the basis of emulsions that make use of surfactants, stand out.

SUMMARY OF THE INVENTION

Although excellent results have been achieved with many of the surfactants described in these and other patents, an object of the present invention is to provide novel biosurfactant materials characterized in that they posses active substances based on alkyl glucosides, glycerol esters and alkyl betaine, which when used in the preparation of crude-in-water emulsions exhibit higher emulsifying capacity and stability. Moreover, these surfactants should also allow for breakage of the emulsion, in a simple manner, once it arrives to the refinery and thus, to recover the dehydrated crude and effect treatment of the contaminated water.

Still another feature of the present invention is the preparation procedure of the emulsions by using biosurfactants.

The crude oil is water emulsion in one embodiment of the invention includes water, crude oil having 8 to 16° API and a biosurfactant. The biosurfactant is preferably included in an amount of about 100 to 10,000 ppm based on the amount of the emulsion. The biosurfactant is selected from the group consisting of a $C_2$-$C_{22}$ alkyl glycoside, a $C_2$-$C_{22}$ alkyl glycerol, a $C_2$-$C_{22}$ alkyl betaine and mixtures thereof. The alkyl groups can be linear or branched. The water phase in the emulsion preferably forms a continuous phase in the emulsion. The water phase can contain a water soluble salt such as NaCl. In other embodiments, the salt can be an alkali metal, alkaline earth metal, inorganic salt or water-soluble salt. The emulsion can include the water in an amount of about 10% to about 70% by volume. The salt can be present in the emulsion in an amount of about 3.5 wt % to about 10 wt % based on the weight of water in the emulsion. The crude oil can be present in an amount of about 30-90 vol % based on the volume of the emulsion.

The various aspects of the invention are basically attained by providing a process for preparing improved heavy crude and extra heavy crude emulsions comprising crude having 20 and 6° API, and preferably between 16 and 8° API, and biosurfactants in water, the process comprising the following steps:

I) premixing: a) dissolving salt (NaCl) in different concentrations by agitation and at room temperature; b) mixing the biosurfactant in the saline solution by using agitation and room temperature to form a premix;

II) preparing the emulsion with the crude and the premix: a) separately heating the premix and the crude between 30 and 90° C., and preferably between 40 and 60° C.; b) slowly adding the crude to the premix, which is maintained with constant agitation level and temperature during the whole process; c) homogenizing the mixture for 2 minutes and left standing another 2 minutes until completing 3 homogenizing-standing cycles in order to obtain the crude-in-water emulsion; d) preparing concentrated emulsions using 55 mL of the precursor emulsion as a basis of calculation taking into account that the water quantity in this emulsion represents between 10 to 70 volume %; e) with constant agitation and temperature (30-60° C.), mixing of a remaining quantity of biosurfactant in order to achieve a concentration of between 100 and 10,000 ppm of biosurfactant in the total volume of the resulting emulsion for each emulsion having 70, 50, 30 or 10 vol % water; f) continuing with constant agitation and temperature to obtain an emulsion-biosurfactant premix; g) separately measuring a balance of crude for preparation of the concentrated emulsion and heating between 30-60° C.; h) slowly adding to the emulsion-biosurfactant premix while keeping constant agitation; i) then, homogenizing the resulting mixture for 2 minutes and left standing another 2 minutes until completing three homogenizing-standing cycles in order to obtain the concentrated crude-in-water emulsion.

The process for producing the crude oil in water emulsion basically comprises forming an aqueous or water solution containing a salt, such as, NaCl in an amount of about 3.5 wt % to about 10 wt %. A biosurfactant is added to the resulting salt solution to form a mixture. The biosurfactants are selected from the group consisting of alkyl glycosides, alkyl glycerol esters, alkyl betaine and mixtures thereof. The crude oil having 8-16° API is admixed with surfactant mixture and emulsified to produce the crude oil-in-water emulsion. The surfactant is included in an amount of about 100 to about 10,000 ppm, preferably about 100 to about 4,000 ppm, and more preferably about 100 to about 2,500 ppm based on the total amount of the emulsion.

In another embodiment, the crude oil-in-water emulsion can be obtained by preparing a first crude oil-in-water emulsion containing the crude oil, water, surfactant and salt. The first emulsion can have a water content greater than the water content of the final desired emulsion. In one embodiment, the first emulsion can have a water content of about 70 vol % to about 90 vol % and a crude content of about 10 vol % to about 70 vol %. The final desired emulsion is obtained by adding the crude oil to the first emulsion and mixing to form the final emulsion containing about 70-90 vol % crude oil and about 10-30 vol % water.

Another feature of the invention is to provide a method for transporting the crude oil in a pipeline or other container. The method includes the steps of preparing a crude oil-in-water emulsion comprising about 70-90 vol % crude oil, about 10-30 vol % water, where the water phase includes a water soluble salt, such as NaCl, in an amount of about 3.5 wt % to 10 wt % based on the weight of the water and a surfactant in an amount of about 100 ppm to 10,000 ppm based on the amount of the emulsion. The surfactant is a biosurfactant selected from the group consisting of a $C_2$-$C_{22}$ alkyl glycoside, a $C_2$-$C_{22}$ glycerol ester, a $C_2$-$C_{22}$ alkyl betaine and mixtures thereof. The resulting crude oil-in-water emulsion is then fed through the pipeline.

These and other features of the invention will become apparent from the following detailed description of the invention.

BRIEF DESCRIPTION OF THE DRAWINGS

In order for a better understanding of the preparation procedure of improved heavy and extra heavy crude oil emulsions by means of biosurfactants in water and the product thereof of the present invention, the following reference is made to the accompanying figures:

FIG. 1 is 10% crude-90% water, and FIG. 2 id 70% crude-30% water.

FIG. 7 and FIG. 8 are glycerol esters; FIG. 9 and FIG. 10 are alkyl betaine; and FIG. 11 and FIG. 12 are alkyl glucosides.

DETAILED DESCRIPTION OF THE INVENTION

Figure 1:
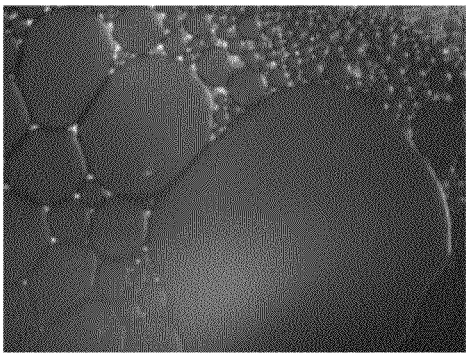
FIGS. 1 and 2 show micrographs of crude-in-water emulsions by using a chemical surfactant SDS (sodium dodecylsulphate) where

According to a more detailed point of view, the present invention refers to an active agent of a surfactant formulation and to a preparation procedure of crude in water emulsions, which are applicable in the transportation of both heavy and extra heavy crude oils. The crude oil is in the range of 20 to 6 API, and preferably between 16 and 8 API. The crude in water emulsions have a substantial stability allowing for traveling long distances along ducts and pipelines.

The surfactant of the invention is a biosurfactant characterized in that it is made up of active substances and selected from the group of commercial biosurfactants, such as, the alkyl glucoside type, glycerol esters, alkyl betaines, and mixtures thereof. The alkyl group of the glucoside contains from 2 to 22 carbon atoms, and preferably from 8 to 18 carbon atoms. Glycerol esters are mono-, di- or tri-esters, but preferably mono- and di-esters. The carbon atom number of the alkyl group of glycerol ester is from 2 to 22 carbon atoms, and preferably 8 to carbon atoms. One example of a glycerol ester is glycerol oleate. The alkyl group of the betaine contains from 2 to 22 carbon atoms, and preferably 8 to 12 carbon atoms.

The process of the present invention includes first, preparing a plurality of solutions with different sodium chloride content for emulating sea water, to which then the biosurfactant is added in a low amount in relation to the crude. The biosurfactant can be added to the salt solution in an amount of about 100 to about 10,000 ppm, preferably about 100 to about 4,000 ppm, and more preferably about 100 to about 2,500 ppm. This solution and the crude (depending on the type) are used at room temperature (15-40° C.) or heated between 30 and 60° C. in order to improve its flowability and handling. The crude is added as a thin line by pouring into the solution containing the salt and the surfactant, while the mixture is agitated in the preparation beaker both by means of a propeller and by manually swirling the container beaker. The preparation system is preferably kept at a constant temperature. Once all the crude is mixed with the aqueous surfactant/salt solution, the resulting mixture is homogenized using a driven homogenizer at a constant rate for 2 minutes, then it left to stand for another 2 minutes, and again another homogenization-standing cycle is started up to three cycles, keeping the temperature constant in the whole process. The resulting emulsion can contain crude oil having 8-16° API, about 10 vol % to about 70 vol % water, about 30 vol % to about 90 vol % crude, about 100 to 10,000 ppm of the surfactant and about 3.5 wt % to about 10 wt % salt based on the weight of the water in the emulsion.

Specifically, the procedure for preparing the subject emulsions in one embodiment of the present invention comprises the following steps:

I. Preparing a premix of the biosurfactant agent with water and the sodium salt. Dissolving a salt, preferably NaCl (3.5-10.5 weight %) in a volume from 1 to 2 liters of deionized water, vigorously and constantly agitating until complete dissolution is reached. Then, weighing the corresponding quantity of surfactant to obtain a concentration between 100 and 4000 ppm according to the total emulsion volume and then dissolving by magnetically agitating the corresponding saline solution volume (containing 3.5-10.5 weight % of the salt) so as to enable forming a crude in water emulsion having between 10 and 70 vol % crude and 90 and 30 vol % water. The surfactant/salt premix is heated to between about 30° and about 60° C. prior to use in preparing the final emulsion.

II. Preparing the emulsion using the crude and the surfactant/salt premix. Crude is heated to between about 30° and about 60° C. and agitated at 100 rpm in a water bath with temperature and agitation control. Both, the crude and premix temperature must be the same and kept constant during the preparation procedure. This is achieved by using a water bath with constant agitation and temperature control. Once the desired preparation temperature is reached in both the crude and the premix, the crude is slowly added as a thin line pouring into the premix container, while agitating with a propeller so as to avoid foaming. Subsequently, by means of a homogenizer the crude-premix mixture is constantly agitated for 2 minutes, then homogenizing is stopped for 2 minutes and then resumed for another 2 minutes, until 3 homogenizing-standing cycles are reached.

Concentrated emulsion preparations (70-90 vol % crude/10-30 vol % water) can also be obtained by starting from a diluted emulsion (10-30 vol % crude/70-90 vol % water) prepared by the above process. In this step, the concentrate emulsion preparation is prepared by starting from the diluted precursor emulsion amount, and heating to between about 30° and about 60° C., to which the corresponding surfactant quantity is slowly and constantly added to stabilize the emulsion thereby increasing the amount of surfactant in the dilute emulsion. Immediately, a corresponding crude volume is slowly added with agitation (propeller) to obtain the corresponding concentrated crude in water emulsion. Preferably, the surfactant and crude are added in amounts to produce the concentrated crude in water emulsion containing about 70% to about 90% crude, about 10% to 30% water by volume, about 100 to about 10,000 ppm surfactant and the salt in an amount of about 3.5 wt % to about 10 wt % based on the amount of water in the emulsion. Finally, once all the crude have been mixed with the first emulsion, three homogenizing-standing cycles are carried out. During the whole process, temperature and agitation level are kept constant. Once obtained, the emulsions are left standing in order to observe its static stability.

In the following examples the importance of the surfactant active agent will be evident as well as the preparation method of the emulsions in a practical application of the present invention.

EXAMPLES

Example 1

According to the preparation procedure of the emulsions of the present invention, a crude-in-water emulsion was obtained without any surfactant, as follows: On a 30 vol % basis of water in the emulsion, the water was heated to 30° C., and the system was kept at a constant temperature during the whole process. Meanwhile, heavy crude (16.4 API) was also heated separately to the same temperature. Crude at 30° C. was poured slowly into the water with constant agitation (propeller) and also keeping the mixture temperature constant at 30 C. Once all the crude was added, the mixture was homogenized at 1800 rpm to form an emulsion by keeping the velocity constant for 2 minutes. In the next two minutes the solution was left standing. This latter homogenizing and standing process was repeated 3 times at the same temperature and homogenizing level conditions. The optical microscopy analysis of the emulsion showed crude droplets of differing sizes dispersed in water (FIG. 1), as well as a resistivity of 1.19 MΩ demonstrating that a crude in water emulsion was obtained. Indeed, the low resistivity value indicates that the emulsion continuous phase is formed by water having a low resistivity and high conductivity. However, crude droplets coalesced over time forming larger droplets and then the emulsion separated into a crude phase and water phase.

Example 2

Figure 2:
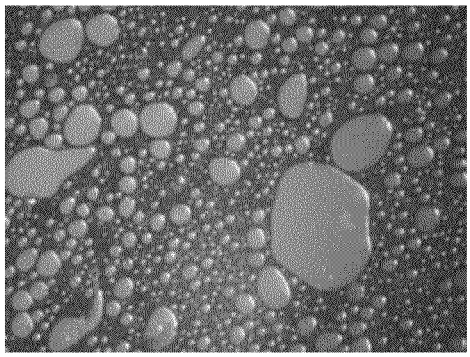

Continuing with the process of the present invention, emulsions without a surfactant were prepared having different salt contents, preferably NaCl, of between 3.5 and 10.5 weight % NaCl. 35, 7 and 100.5 grams of NaCl were dissolved in 1 liter of distilled water by agitating at room temperature and obtaining solutions of 3.5, 7.0 and 10.5 weight % of this salt in water in order to emulate sea water with different salt contents. An emulsion of 70 vol % crude in 30 vol % water for each NaCl concentration was prepared. The water containing salt is poured into the preparation container and heated to 30° C., keeping this temperature constant while the crude is added. Heavy crude oil (16.4° API) was added following the same sequence as in Example 1 to form the emulsions. Once the emulsion preparations are finished, in order to evidence the salt concentration effect, each emulsion was analyzed by evaluating the resistivity, stability and optical microscopy. Resistivity study showed much higher values than the result in Example 1 (16.19, 19.57 and 17.81 MΩ), which demonstrates that emulsions of the water in crude type were obtained, that is, wherein the continuous phase is comprised by high resistivity and low conductivity crude oil. As the salt content premixed in water increases, emulsions become more closed making them impossible to be viewed by a microscope. However, when water without salt is added to a droplet of these emulsions, it can be observed how it dilutes through the water continuous phase (FIG. 2) and it is confirmed that indeed it is a water-in-crude emulsion.

Example 3

According to the procedure of the present invention, a series of emulsions were prepared by obtaining in a first phase of this preparative method a highly diluted crude-in-water emulsion by adding a commercial chemical surfactant, such as sodium dodecylsulphate (SDS) and salt-free, referred to as the precursor emulsion. Starting from a basis of calculation of 90 vol % of water in the resulting emulsion, this was mixed with approximately 600 mg of the surfactant SDS at room temperature. Both components premix of the surfactant and water and the crude were heated separately at 30° C. and agitated to maintain a homogeneous temperature. Once the temperature is controlled at 30° C., heavy crude of 16.4° API was poured into the surfactant/water premix by keeping temperature and agitation constant until the mixing process is completed. The mixture was homogenized for 2 minutes and then left standing another 2 minutes until 3 homogenizing-standing cycles were completed in order to obtain the crude-in-water emulsion (10 vol % crude/90 vol % water and containing the surfactant). This emulsion is referred to as a precursor emulsion. In preparing the concentrated emulsions, 55 mL of the precursor emulsion was taken as the basis of calculation and water quantity in this emulsion was regarded as representing 70, 50, or 30 volume % water, according to each case. Balance Surfactant was mixed to obtain a concentration of between 3000 and 4000 ppm of surfactant in the total volume of the resulting emulsion, for each emulsion content of 70, 50, and 30 vol % water, respectively, with constant agitation and temperature (30° C.). As constant agitation and temperature of the precursor emulsion continued, 15.7, 44 and 110 mL of crude, respectively, were measured and heated at 30° C. and then added in a slow fashion into the precursor emulsion while maintaining constant agitation. Subsequently, the same emulsifying procedure as in Example 1 was followed through 3 homogenizing-standing cycles. Microscopy results showed water droplets of differing sizes covered by crude, exhibiting high mobility and a trend to coalesce. As crude/water ratio increases, the emulsion reverts because a higher amount of water droplets is present in the crude.

Resistivity results showed an initial value of between 0.23-0.31 MΩ when the crude/water % ratio was 50/50, indicating that the crude-in-water emulsion formed in the beginning is present in a great amount of free water, and when the crude in water ratio increases, the emulsion tends to revert.

Example 4

Figure 3:
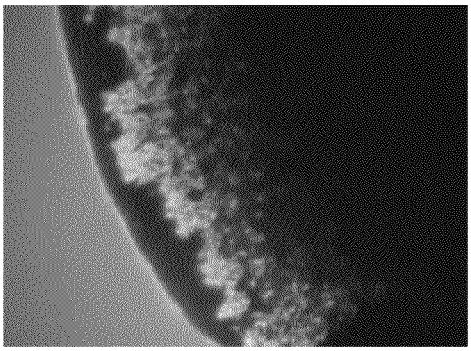
FIG. 3 shows micrographs of crude-in-water emulsions by using a chemical surfactant (SDS) of a precursor emulsion 30 vol % crude/70 vol % water.
Figure 4:
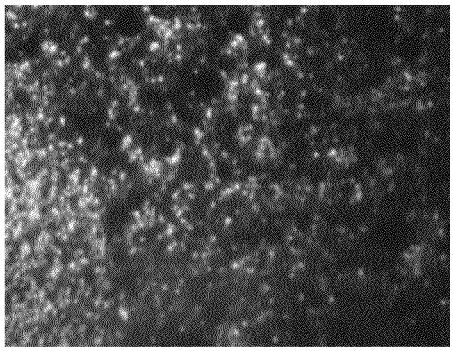
FIG. 4 is a concentrated emulsion 70 vol % crude in 30 vol % water.

According to the preparation procedure in Example 3, two emulsions were prepared one of which is a precursor with 70 vol % water, and from which a concentrated emulsion is obtained having only 30 vol % water, both salt free. The crude oil used was of heavy type and 16.4° API. In both cases 2500 and 4000 ppm of commercial chemical surfactant SDS were used, respectively. In FIGS. 3 and 4, crude-in-water emulsions of the present invention are shown, which utilize a chemical surfactant SDS. a) precursor emulsion 30 vol % crude/70 vol % water, b) concentrated emulsion 70 vol % crude in 30 vol % water.

Microscopy results of the precursor emulsion showed crude clusters suspended in water, while in the concentrated emulsion well defined crude spheres appeared dispersed in water as shown in FIGS. 3 and 4. In both cases, resistivity results were 0.39 MQ, indicating an emulsion of the crude-in-water type.

Example 5

Figure 5:
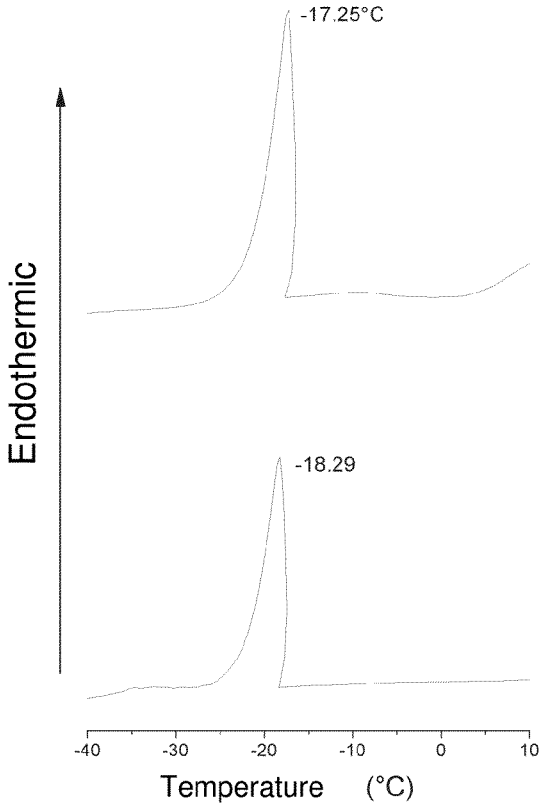
FIG. 5 shows a thermogram of an emulsion of 70 vol % crude/30 vol % water with chemical surfactant.

By using the same preparation procedure as in Example 4, emulsions having a salt content of 3.5 weight % NaCl in relation to water volume used and a content of between 3000 and 4000 ppm of surfactant were obtained. For the first premixing step, distilled water was used in which salt, similar to Example 2, was dissolved at room temperature. The surfactant (SDS) was mixed at room temperature with saline solution and this premix heated at 30° C. in order to carry out the same procedure as in Example 3, that is to say, a first precursor emulsion was prepared having 70 vol % water then, from this, another emulsion was obtained having 30 vol % water in which, in order to complement the surfactant quantity with the remaining amount, 55 mL of the precursor emulsion was mixed. It was observed that the first precursor emulsion obtained with 3.5 weight % NaCl and 70 vol % water was highly unstable, however the emulsion obtained there from, was highly stable and very thick having a low free water content. It could not be observed under the microscope. Resistivity results (0.66 and 9.74 MΩ) show a reversion of crude-in-water emulsion to water-in-crude emulsion very probably due to the effect of the crude/water ratio. In this case the use of an anionic chemical surfactant such as SDS does not allow for the obtaining of a stable crude in water emulsion at low water content. Stability results by means of differential scanning calorimetry of the concentrated emulsion with a 70 vol % crude/30 vol % water ratio are shown in FIG. 5. Cooling thermograms showed a monomodal exothermic peak around −17° C. characteristic of water crystallization, which practically remains unvaried in the cooling cycles of the emulsion prepared with the chemical surfactant, and defining a stable crude in water emulsion. In the case of the emulsion prepared with a biosurfactant, the appearance of diverse exothermic series that correspond to water in the second cooling cycle was observed, and allowed for its identification as a less stable crude in water emulsion.

Figure 6:
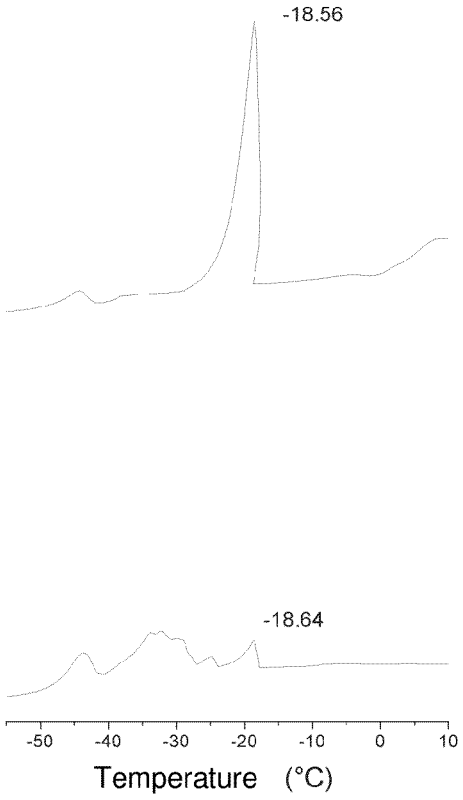
FIG. 6 shows the biosurfactant after two cooling cycles.

In the figures, thermograms of an emulsion 70 vol % crude/vol % water with chemical surfactant in FIG. 5 and biosurfactant in FIG. 6 in two cooling cycles are shown.

Example 6

Following the preparation method in Example 5 for a salt content of 3.5 weight % NaCl, emulsions having 70 and 30% water were prepared having 70 and 30 vol % water by using biosurfactants which active agents are alkyl glucosides, glycerol esters and alkyl betaine. In this example, six emulsions were obtained. Microscopy results in FIGS. 7-12 indicate that in all cases crude-in-water emulsions were formed. However, in the case of the emulsion in which an alkyl glucoside is used as a surfactant active agent resulted in a more homogeneous and apparently more stable droplet. According to the resistivity results (0.23, 0.27, 0.43, >10 MΩ, 0.01 and 0.03) of these emulsions, those prepared from alkyl glucoside showed less resistivity.

Figure 7:
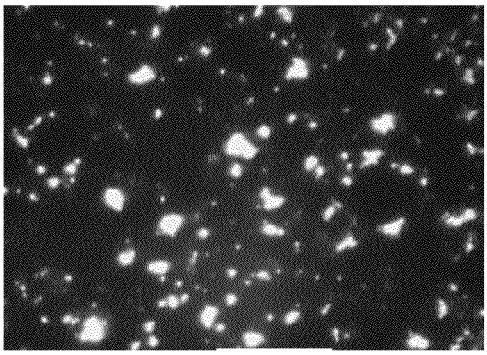
FIGS. 7-12 show microscopy results of emulsions of crude in water by using different surfactants with 70 and 30 vol % water, respectively, where
Figure 8:
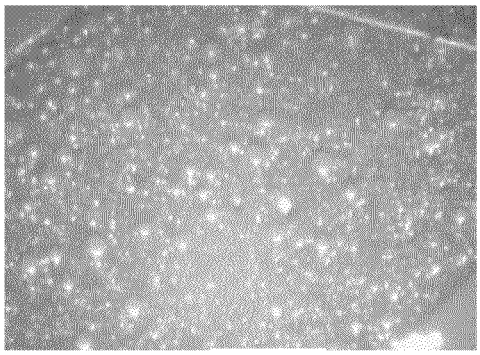
Figure 9:
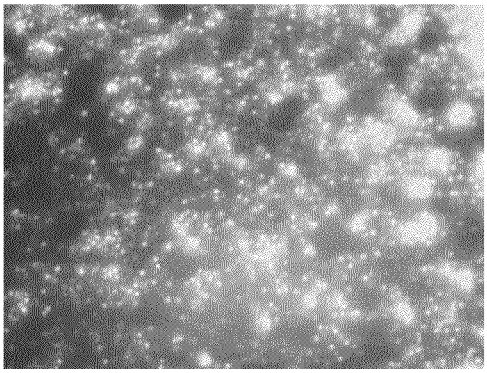
Figure 10:
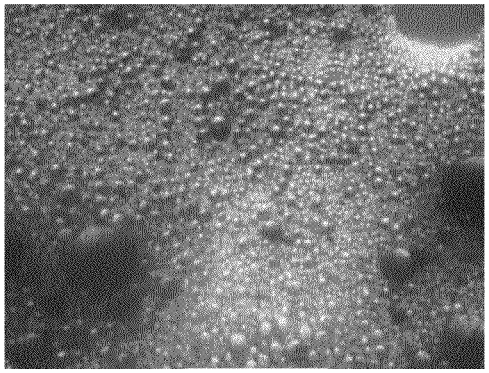
Figure 11:
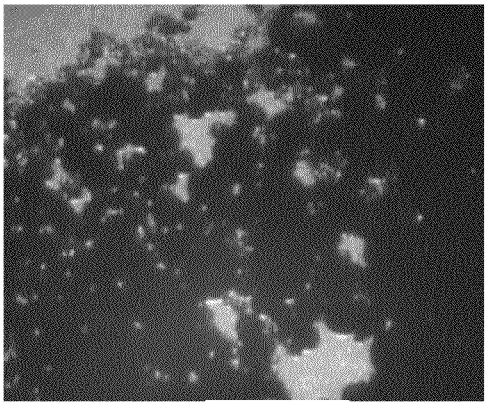
Figure 12:
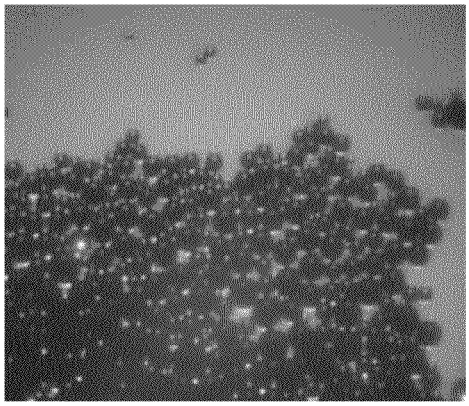

FIGS. 7-12 are microscopy results of emulsions of crude in water by using different surfactants with 70 and 30 vol % water, respectively: FIG. 7 and FIG. 8 glycerol esters; FIG. 9 and FIG. 10 alkyl betaine; FIG. 11 and FIG. 12 alkyl glucosides.

Example 7

According to the preparation procedure in Example 6, reference crude in water emulsions were prepared without using a biosurfactant and salt. The precursor emulsion having 70 vol % water was prepared first, and from this, another was obtained having 30 vol % water. Resistivity results showed a high value compared to the crude-water system, which can serve as evidence that the emulsion obtained is of the water in crude type. The micrograph of the precursor sample (70 vol % water) showed crude in water droplets tending to rapidly coalesce. However as the water content decreased the emulsion formed could not be seen clearly under the microscope, because it was dark and closed, with a few large crude droplets. Also, it can be appreciated the importance of the biosurfactant as is highlighted in Example 6, which allows stabilization of crude droplets dispersed in water.

Example 8

According to the preparation procedure and the use of new surfactants of the present invention, emulsions were prepared from extra heavy crude oil, 8 API heavy crude residue, by using a biosurfactant (glycerol ester). In a first step of this method, a highly diluted crude in water emulsion was obtained by adding a surfactant (active agent) and 3.5 vol % NaCl in the water volume to form the precursor emulsion. Starting from a basis of calculation of 55 mL of distilled water with 3.5 weight % salt, which would form the 70% water in the emulsion, this was mixed with about 600 mg of the surfactant at room temperature and then the emulsifying process was initiated by heating the resulting premix at 60° C. Both components of the premix and the crude were heated separately at 60° C. and agitated to maintain a homogeneous temperature. Once the temperature is controlled at 60° C., extra heavy crude was poured into the premix while keeping temperature and agitation constant until the mixing process is completed. The mixture was homogenized for 2 minutes and then left standing for another 2 minutes until three homogenizing-standing cycles were completed in order to obtain the crude-in-water precursor emulsion (30 vol % crude/70 vol % water). In preparing the concentrated emulsions, 55 mL of the precursor emulsion was taken as the basis of calculation and water quantity in this emulsion was considered as representing 30 volume %. The balance Surfactant was mixed to obtain a concentration of between 3000 and 4000 ppm of surfactant in the total volume of the resulting emulsion, with constant agitation and temperature (60° C.). As constant agitation and temperature of the premix continued, crude was heated separately at 60° C. and then it was added slowly in the premix while maintaining constant agitation. Subsequently, the same emulsifying procedure as in Example 1 was followed through three homogenizing-standing cycles.

Example 9

According to the preparation procedure in Example 6, a crude in water emulsion was prepared without salt but with the mix of two base biosurfactants: alkyl glucoside and glycerol oleate in a 1:1 proportion. Final water proportion was 30% and 2000 ppm of the biosurfactant mixture. Optical microscopy shows obtaining of a stable crude in water emulsion by using the biosurfactant mixture (FIG. 13), unlike the emulsion obtained in Example 5 with a chemical surfactant such as SDS.

Figure 13:
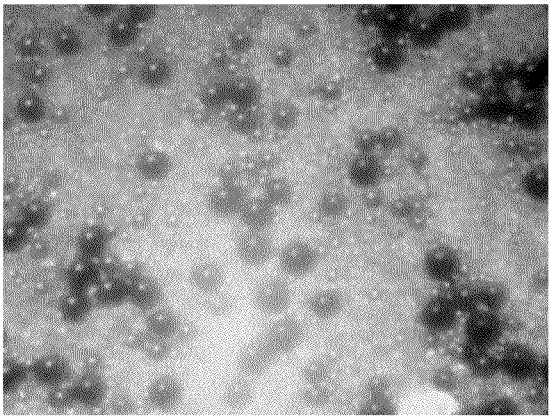
FIG. 13 shows a micrograph of the crude in water emulsion (7:3 v/v) by using a 1:1 mixture of biosurfactants based on alkyl-glucosides $C_{12}$-$C_{18}$ and glycerol oleate.

FIG. 13 shows micrographs of the crude in water emulsion (7:3 v/v) by using a 1:1 mixture of biosurfactants based on alkyl-glucosides C12-C18 and glycerol oleate.

What is claimed is:

1. A process for preparing concentrated heavy crude and extra heavy crude-in-water emulsions comprising crude having between 20 and 6° API and biosurfactants in water, the process comprising the following steps:

I) premixing comprising: a) dissolving a salt in different concentrations by agitation and at room temperature to form a saline solution; and b) mixing the biosurfactant in the saline solution by using agitation and room temperature to form a surfactant premix;

II) preparing concentrated emulsion with the crude and the surfactant premix comprising: a) separately heating the surfactant premix and the crude between 30 and 90° C.; b) adding the crude to the surfactant premix with constant agitation and temperature; c) homogenizing the resulting mixture for 2 minutes and left standing another 2 minutes until completing 3 homogenizing-standing cycles to obtain a crude-in-water precursor emulsion; d) mixing with constant agitation and temperature (30-60° C.), an additional quantity of biosurfactant to said precursor emulsion to achieve a biosurfactant concentration between 100 and 10,000 ppm of biosurfactant in the total volume of the resulting precursor emulsion; e) continuing with constant agitation and temperature to obtain an emulsion-biosurfactant premix; f) separately measuring a balance of crude for preparation of the concentrated emulsion and heating between 30-60° C.; g) adding said crude to the emulsion-biosurfactant premix with constant agitation; h) then, homogenizing the resulting mixture for 2 minutes and left standing another 2 minutes until completing three homogenizing-standing cycles in order to obtain the concentrated crude-in-water emulsion having a water content of 10 to 70 vol %.

2. The process for preparing the concentrated crude-in-water emulsion according to the process of claim 1, wherein an aqueous phase has a salt content between 3.5 and 10.5 weight % based on quantity of water in the concentrated crude-in-water emulsion.

3. The process for preparing the concentrated crude-in-water emulsion according to claim 2, wherein the aqueous phase contains the biosurfactant in an amount of 100-400 ppm based on the total quantity of the resulting concentrated crude-in-water emulsion.

4. The process for preparing the concentrated crude-in-water emulsion according to claim 2, wherein the biosurfactant is selected from the group consisting of an alkyl glucoside, glycerol ester, alkyl betaine surfactant, and mixtures thereof.

5. The process for preparing the concentrated crude-in-water emulsion according to claim 4, wherein the alkyl group of the glucoside contains from 2 to 22 carbon atoms.

6. The process for preparing the concentrated crude-in-water emulsion according to claim 4, wherein the glycerol ester is a mono-, di- or tri-ester, preferably mono- and di-ester having 2 to 22 carbon atoms.

7. The process for preparing the concentrated crude-in-water emulsion according to claim 4, wherein the alkyl group of the betaines contain from 2 to 22 carbon atoms.

8. The process of claim 4, wherein said alkyl group of the glucoside, the glycerol ester, and the alkyl group of the betaines have 8 to 18 carbon atoms.

9. The process for preparing the concentrated crude-in-water emulsion according to claim 2, wherein the concentrated crude-in-water emulsion comprises 30-90 vol % hydrocarbons (6 to 20° API) and from 70-10 vol % water based on the volume of the emulsion, 100-10000 ppm of biosurfactant based on the precursor emulsion and 3.5-10 weight % salt based on the weight of the water in the emulsion.

10. A process for preparing a crude oil-in-water emulsion comprising the steps of:

forming a mixture containing water, NaCl and a biosurfactant selected from the group consisting of alkyl glycosides, glycerol esters, alkyl betaines and mixtures thereof to obtain an aqueous surfactant mixture;

admixing the crude oil with the aqueous surfactant mixture and emulsifying the mixture to obtain said crude oil in water precursor emulsion;

adding an additional amount of said biosurfactant to said precursor emulsion and adding additional crude to the resulting mixture to obtain the crude oil-in-water emulsion including about 10-30 vol % water containing 3.5-10 wt % of said NaCl, said crude oil being 8 to 16° API and said biosurfactant being present in an amount of about 100 ppm to about 10,000 ppm based on the total amount of the crude oil-in-water emulsion.

11. The process of claim 10, wherein said precursor emulsion has a water content of 70-90% by volume and a crude oil content of 10-30% by volume, and said concentrated crude-in-water emulsion has a crude oil content of 70-90% and a water content of 10-30% by volume.

12. The process of claim 11, wherein said biosurfactant is a $C_2$-$C_{22}$ alkyl glycoside.

13. The process of claim 11, wherein said biosurfactant is a $C_2$-$C_{22}$ alkyl glycerol ester.

14. The process of claim 11, wherein said biosurfactant is a $C_2$-$C_{22}$ alkyl betaine.

15. The process of claim 1, wherein said crude has 8-16° API.

16. The process of claim 1, wherein said crude-in-water precursor emulsion has a water content of 70-90% by volume and a crude oil content of 10-30% by volume and where said concentrated crude-in-water emulsion has a crude oil content of 70-90% and a water content of 10-30% by volume.

17. The process of claim 1, wherein said crude-in-water precursor emulsion consists essentially of saline solution, crude oil and said biosurfactant, where said biosurfactant is selected from the group consisting of a $C_2$-$C_{22}$ alkyl glycoside, a $C_2$-$C_{22}$ alkyl glycerol ester, a $C_2$-$C_{22}$ alkyl betaine, and mixtures thereof.

18. A process of transporting crude oil comprising the steps of:

preparing a crude oil-in-water emulsion comprising 70-90 vol % crude oil having 8-16° API, 10-30 vol % water, about 3.5 wt % to about 10 wt % NaCl based on the amount of water, and a surfactant in an amount of about 100 ppm to about 10,000 ppm based on the amount of water in the emulsion, said surfactant being selected from the group consisting of a $C_2$-$C_{22}$ alkyl glycoside, a $C_2$-$C_{22}$ alkyl glycerol ester, a $C_2$-$C_{22}$ alkyl betaine, and mixtures thereof, wherein said crude-in-water emulsion is prepared by the steps of:

forming a mixture containing water, NaCl and a biosurfactant selected from the group consisting of alkyl glycosides, glycerol esters, alkyl betaines and mixtures thereof to obtain an aqueous surfactant mixture;

admixing the crude oil with the aqueous surfactant mixture and emulsifying the mixture to obtain said crude oil-in-water precursor emulsion;

adding an additional amount of said biosurfactant to said precursor emulsion and adding additional crude to the resulting mixture to obtain the crude oil-in-water emulsion, said crude oil being 8 to 16° API and said biosurfactant being present in an amount of about 100 ppm to about 10,000 ppm based on the total amount of water in the crude oil-in-water emulsion; and feeding said emulsion through a pipeline.

19. The process of transporting crude oil of claim 18, wherein said precursor emulsion has a water content of 70-90% by volume and a crude oil content of 10-30% by volume, and said concentrated crude-in-water emulsion has a crude oil content of 70-90% and a water content of 10-30% by volume.

20. The process of claim 19, wherein said concentrated crude-in-water emulsion consists essentially of crude oil, water and said biosurfactant.

21. The process of claim 20, wherein said biosurfactant is a $C_2$-$C_{22}$ alkyl glycoside.

22. The process of claim 20, wherein said biosurfactant is a $C_2$-$C_{22}$ alkyl glycerol ester.

23. The process of claim 20, wherein said biosurfactant is a $C_2$-$C_{22}$ alkyl betaine.

* * * * *